US010220983B1

(12) United States Patent
Gilliam

(10) Patent No.: US 10,220,983 B1
(45) Date of Patent: Mar. 5, 2019

(54) THREADED BOTTLE RING AND METHOD OF FABRICATION AND ATTACHMENT

(71) Applicant: James R. Gilliam, Clearwater, FL (US)

(72) Inventor: James R. Gilliam, Clearwater, FL (US)

( * ) Notice: Subject to any disclaimer, the term of this patent is extended or adjusted under 35 U.S.C. 154(b) by 0 days.

(21) Appl. No.: 15/219,760

(22) Filed: Jul. 26, 2016

Related U.S. Application Data

(60) Provisional application No. 62/197,357, filed on Jul. 27, 2015.

(51) Int. Cl.
*B65D 41/08* (2006.01)
*B65D 1/02* (2006.01)
*B65D 85/72* (2006.01)

(52) U.S. Cl.
CPC ..... *B65D 41/08* (2013.01); *B65D 1/023* (2013.01); *B65D 1/0207* (2013.01); *B65D 85/72* (2013.01)

(58) Field of Classification Search
CPC ..... B65D 41/00–41/62; B65D 85/72; B65D 1/0207; B65D 1/023; B21D 51/00–51/44
USPC ..... 215/40–55, 274; 220/319, 703; 493/52–185
See application file for complete search history.

(56) References Cited

U.S. PATENT DOCUMENTS 3,156,279 A * 11/1964 Grebowiec ..... A45D 40/0068 215/12.1
3,434,615 A * 3/1969 Barletta ..... B01L 3/5021 215/276
3,656,646 A * 4/1972 Taylor ..... B65D 50/06 215/206
3,787,547 A * 1/1974 Stephan ..... B29C 49/0073 215/335
4,014,448 A * 3/1977 Greenberg ..... B28B 1/002 215/44
4,964,205 A * 10/1990 Coffman ..... B29C 51/12 264/512
5,024,341 A * 6/1991 Dekerle ..... A61J 11/04 215/11.1
6,415,937 B1 * 7/2002 DeJong ..... A61J 11/04 215/11.1
6,845,887 B1 * 1/2005 Granger ..... B65D 47/043 222/153.06
7,185,775 B1 * 3/2007 Decal ..... A61J 11/04 215/11.1
7,434,702 B2 * 10/2008 Yaita ..... B29C 45/0062 215/274
8,360,266 B2 * 1/2013 Adams ..... B65D 1/0246 220/669
2003/0132188 A1 * 7/2003 Beek ..... B65D 41/08 215/44

(Continued)

*Primary Examiner* — Kareen K Thomas

(57) ABSTRACT

A one piece metal bottle has an open mouth and a neck with a smooth exterior surface and an threaded bottle ring. An interior neck surface of the threaded bottle ring has a smooth configuration positionable upon the neck of the bottle. An exterior neck surface has male threads adapted to removably receive a crown cap. An annular lower edge is positionable in contact with at least one axial projection extending outwardly from the bottle, below and in contact with the threaded bottle ring, to abate downward movement of the threaded bottle ring. An annular upper edge is positionable in contact with a collar formed in an annular cylindrical configuration extending outwardly from the bottle, above and in contact with the threaded bottle ring, to abate upward movement of the threaded bottle ring.

2 Claims, 5 Drawing Sheets

(56) References Cited

U.S. PATENT DOCUMENTS

2004/0169002 A1* 9/2004 White-Wooten ..... A47G 19/2266 215/388
2006/0151420 A1* 7/2006 Espenschied ..... A61J 11/04 215/276
2006/0266727 A1* 11/2006 Spatz ..... B65D 41/0464 215/252
2007/0080128 A1* 4/2007 Laveault ..... B65D 1/023 215/44
2010/0126990 A1* 5/2010 Fontana ..... B65D 1/0246 220/23.4
2010/0133221 A1* 6/2010 Levis ..... A61J 9/00 215/11.1
2011/0114595 A1* 5/2011 Heiberger ..... B65D 47/06 215/329
2011/0127232 A1* 6/2011 Willows ..... B65D 47/088 215/354
2014/0103003 A1* 4/2014 Giovannini ..... B65D 1/0246 215/44
2014/0263150 A1* 9/2014 Robinson ..... B21D 51/38 215/44
2015/0158621 A1* 6/2015 Lee ..... B65D 45/325 215/44

* cited by examiner

FIG. 1
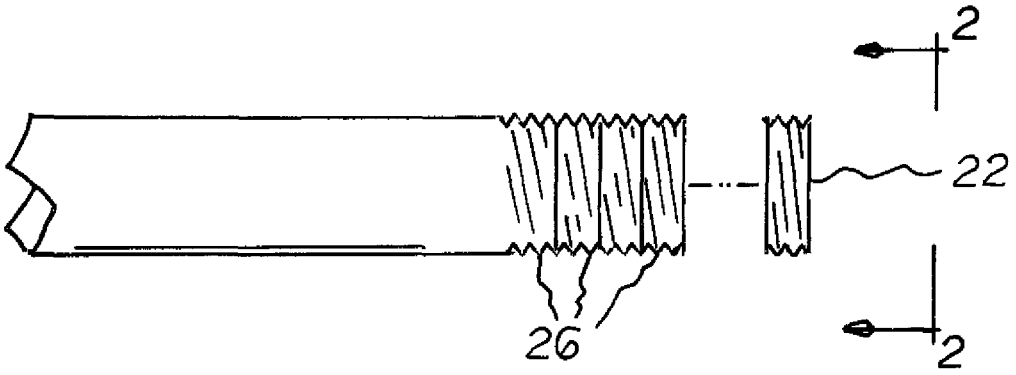
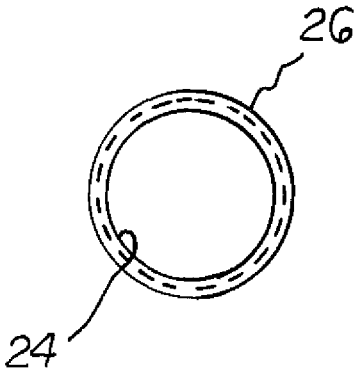
FIG. 2
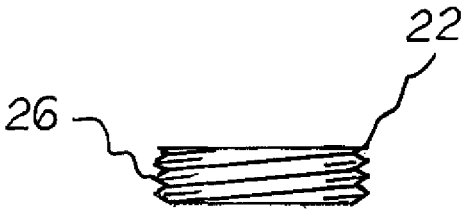
FIG. 3

FIG. 9
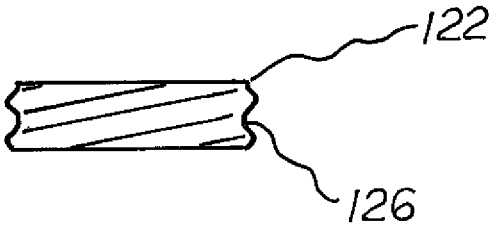
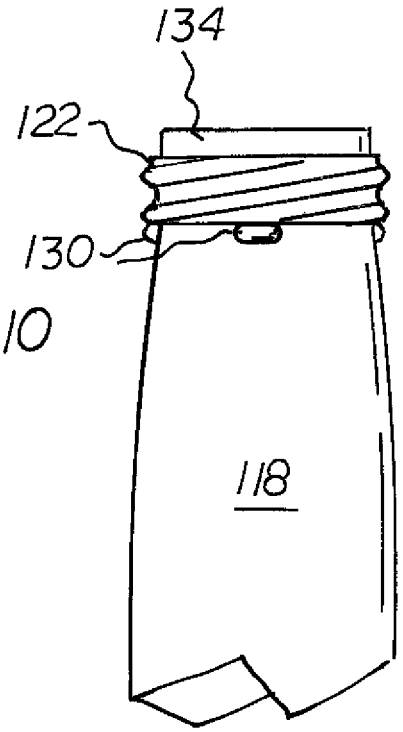
FIG. 10
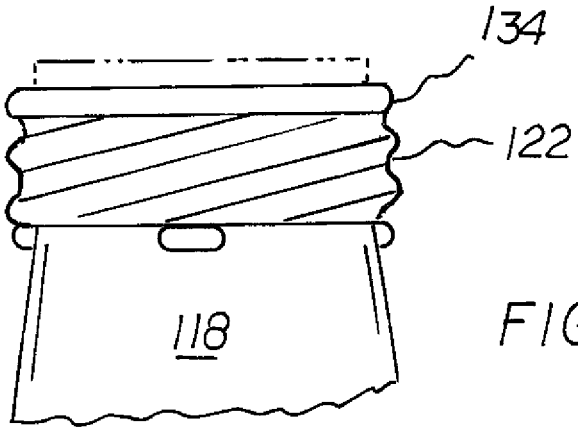
FIG. 11

THREADED BOTTLE RING AND METHOD OF FABRICATION AND ATTACHMENT

RELATED APPLICATION

The present application is based upon and claims the benefit of Provisional Application Ser. No. 62/197,357 filed Jul. 27, 2015, the subject matter of which is incorporated herein by reference.

BACKGROUND OF THE INVENTION

Field of the Invention

The present invention relates to a threaded bottle ring and more particularly pertains to a threaded aluminum bottle with a threaded bottle ring and to a method of fabrication and attachment.

Description of the Prior Art

The use of threaded bottles is known in the prior art. More specifically, threaded bottles previously devised and utilized for the purpose of storing and transporting beverages are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives, and requirements, they do not describe a threaded aluminum bottle with a threaded bottle ring and a method of fabrication and attachment.

Therefore, it can be appreciated that there exists a continuing need for a new and improved threaded aluminum bottle with a threaded bottle ring and for a method of fabrication and attachment. In this regard, the present invention substantially fulfills this need.

SUMMARY OF THE INVENTION

In view of the disadvantages inherent in the known types of threaded bottles now present in the prior art, the present invention provides an improved threaded bottle ring and method of fabrication and attachment. As such, the general purpose of the present invention, which will be described subsequently in greater detail, is to provide a new and improved threaded bottle ring and method of fabrication and attachment which has all the advantages of the prior art and none of the disadvantages.

To attain this, from a broad perspective, the present invention essentially comprises a one piece metal bottle having an open mouth and a neck with a smooth exterior surface and an improved threaded bottle ring. The improved threaded bottle ring includes an interior neck surface having a smooth configuration positionable upon the neck of the bottle. An exterior neck surface has male threads adapted to removably receive a crown cap. An annular lower edge is positionable in contact with at least one radial projection extending outwardly from the bottle, below and in contact with the threaded bottle ring, to abate downward movement of the threaded bottle ring. An annular upper edge is positionable in contact with a collar formed in an annular cylindrical configuration extending radially outwardly from the bottle, above and in contact with the threaded bottle ring, to abate upward movement of the threaded bottle ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle with a threaded bottle ring and method of fabrication and attachment which has all of the advantages of the prior art bottles and none of the disadvantages.

It is another object of the present invention to provide a new and improved threaded bottle ring and method of fabrication and attachment which may be easily and efficiently manufactured and marketed.

It is a further object of the present invention to provide a new and improved threaded bottle ring and method of fabrication and attachment which is of durable and reliable constructions.

An even further object of the present invention is to provide a new and improved threaded bottle ring and method of fabrication and attachment which is susceptible of a low cost of manufacture with regard to both materials and labor, and which accordingly is then susceptible of low prices of sale to the consuming public, thereby making such threaded bottle ring and method of fabrication and attachment economically available to the buying public.

Lastly, it is an object of the present invention to provide an aluminum bottle with a threaded bottle ring and method of fabrication and attachment.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is side elevational view of a cylinder or tube of aluminum being measured and cut into threaded bottle rings for use in fabricating all aluminum battles.

FIG. 2 is an end elevational view taken along line 2-2 of FIG. 1.

FIG. 3 is a front elevational view of the threaded bottle rings of FIG. 2 but with male threads formed thereon.

FIG. 9 is a front elevational view similar to FIG. 3 but illustrating an alternate embodiment of the invention.

FIG. 10 is a front elevational view similar to FIG. 6 but with the FIG. 9 ring.

FIG. 11 is a front elevational view similar to FIG. 10 but with the upper section of the bottle to be rolled over to secure the ring in place.

The same reference numerals refer to the same parts throughout the various Figures illustrating the various embodiments.

DESCRIPTION OF THE PREFERRED EMBODIMENT

Figure 4:
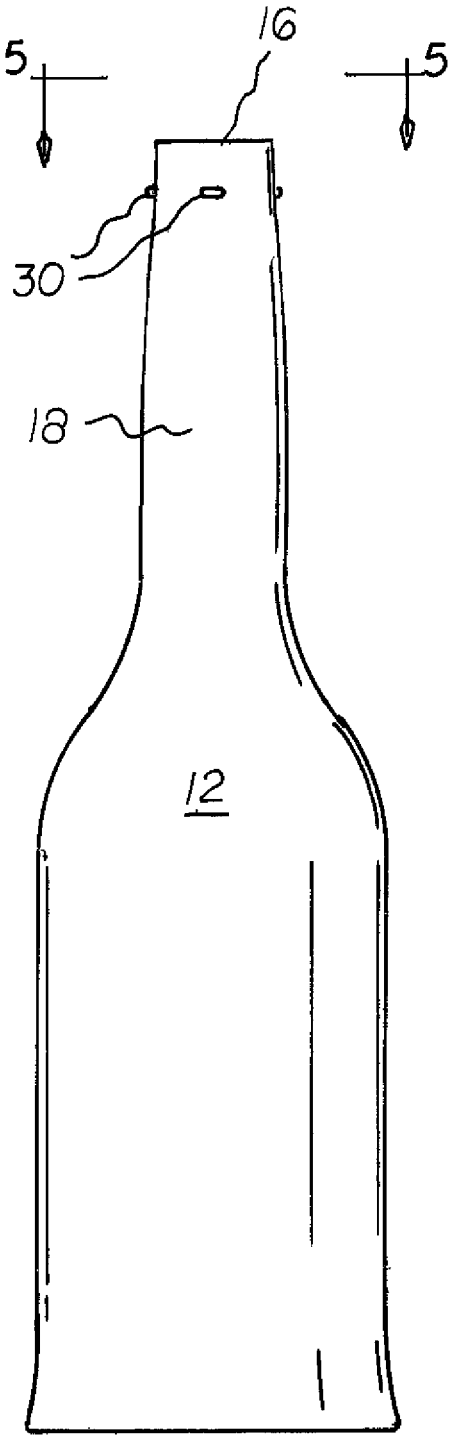
FIG. 4 is a front elevational view of an aluminum bottle for receiving an aluminum threaded bottle rings shown in FIG. 4.
Figure 5:
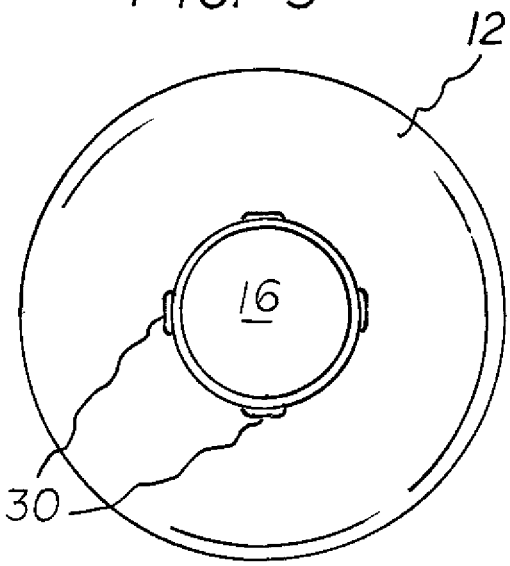
FIG. 5 is a plan view of the bottle taken along line 5-5 of FIG. 4.
Figure 6:
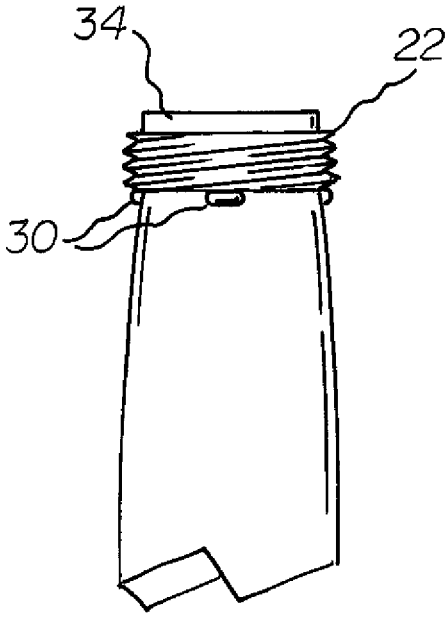
FIG. 6 is an enlarged front elevational view of the bottle of FIG. 4 with the threaded bottle rings of FIG. 3 slid there upon.
Figure 7:
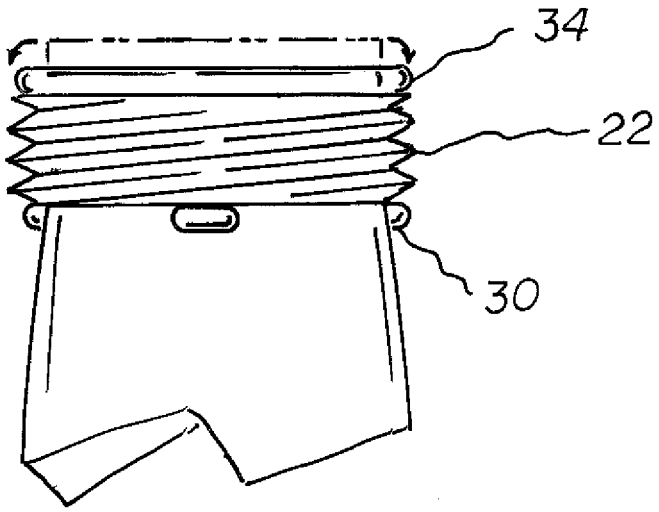
FIG. 7 is a front elevational view similar to FIG. 6 but with a section of the bottle partially rolled over to secure the threaded bottle rings on the bottle.
Figure 8:
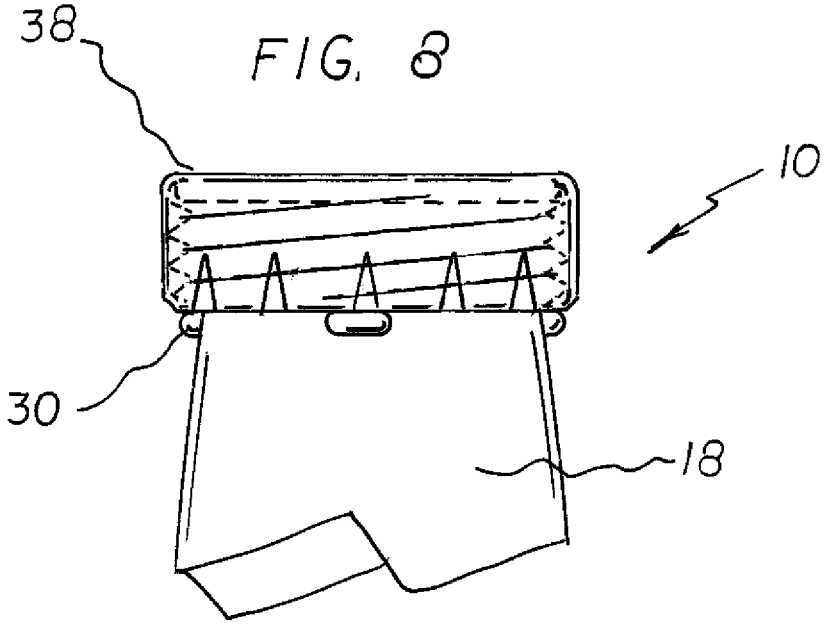
FIG. 8 is a front elevational view similar to FIG. 7 but with the upper extent of the bottle fully rolled over and a threaded cap crimped into position.
Figure 12:
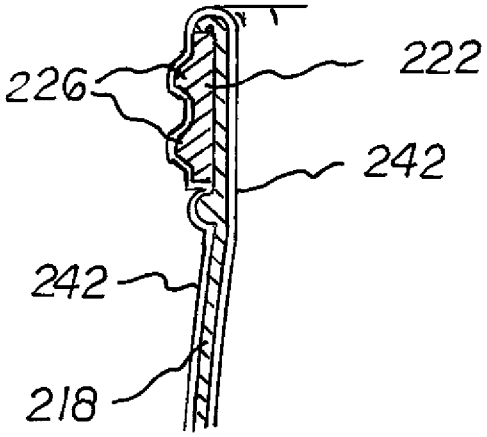
FIG. 12 is a cross sectional view taken along line 12-12 of FIG. 11.
Figure 13:
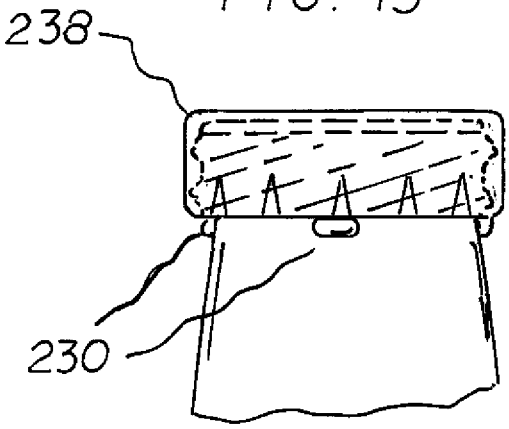
FIG. 13 is a front elevational view of similar to FIG. 11 but with cap crimped thereon.

With reference now to the drawings, and in particular to FIG. 1 thereof, the preferred embodiment of the new and improved threaded bottle ring and method of fabrication and attachment embodying the principles and concepts of the present invention and generally designated by the reference numeral 10 will be described.

The present invention, the threaded bottle ring and method of fabrication and attachment 10 is comprised of a plurality of components. Such components in their broadest context include a one piece metal bottle having an open mouth and a neck with a smooth exterior surface and an improved threaded bottle ring. The improved threaded bottle ring includes an interior neck surface having a smooth configuration positionable upon the neck of the bottle. An exterior neck surface has male threads adapted to removably receive a crown cap. An annular lower edge of the threaded bottle ring is positionable in contact with at least one radial projection extending outwardly from the bottle, below and in contact with the threaded bottle ring, to abate downward movement of the threaded bottle ring. An annular upper edge of the threaded bottle ring is positionable in contact with a collar formed in an annular cylindrical configuration extending outwardly from the bottle, above and in contact with the threaded bottle ring, to abate upward movement of the threaded bottle ring. Such components are individually configured and correlated with respect to each other so as to attain the desired objective.

From a specific perspective, the invention of the present application is a one piece aluminum bottle 12. Such bottle includes a closed bottom 14 and an open mouth 16 and a neck 18 with a smooth frusto-conical exterior configuration. The bottle has a central axis with the neck at an angle of from 0.5 to 2.5 degrees.

Next provided is a threaded bottle ring 22. The threaded bottle ring is formed with an interior surface 24 having a smooth cylindrical configuration positioned in facing contact upon the neck of the bottle. The threaded bottle ring is formed with an exterior surface having male threads 26. The male threads has crests of a first diameter. The threaded bottle ring has an annular upper edge and an annular lower edge. The treaded bottle ring is fabricated of aluminum.

A plurality of radial projections 30 extend outwardly from the bottle, below and in contact with the lower edge of the threaded bottle ring, to abate downward movement of the threaded bottle ring.

A collar 34 is formed in an annular cylindrical configuration extending outwardly from the bottle, above and in contact with the upper edge of the threaded bottle ring, to abate upward movement of the threaded bottle ring. The collar has a second diameter less than the first diameter. The neck and the ring are coated with a flavor guard polymer 42.

A crown cap 38 is removably positioned on and in contact with the threaded bottle ring male threads of the threaded bottle ring and the collar.

Lastly, a beverage is within the bottle. The beverage is adapted to be consumed following removal of the crown cap.

In one embodiment of the invention, the threaded exterior surface includes a single thread requiring a 180-270 degree twist for uncoupling a cap from the threaded bottle ring. In alternate embodiments of the invention, the threaded exterior surface includes a plurality of concentric threads requiring less than a 180-270 degree twist for uncoupling a cap from the threaded bottle ring.

In the embodiment of the invention, the neck of the bottle is frusto-conical and the interior surface of the ring is cylindrical. It should be understood however that the neck of the bottle is an interior facing surface and the interior surface of the ring is an exterior facing surface. At least one of the facing surfaces is frusto-conical. In another embodiment, at least one of the facing surfaces is cylindrical.

The present invention also includes a method of fabricating a one piece aluminum bottle. The method includes the following steps.

The first step is providing an aluminum bottle having a closed bottom and an open mouth and a neck with a smooth frusto-conical exterior configuration.

The next step is creating a threaded bottle ring from a cylinder/tube of aluminum by forming male threads into the cylinder/tube then cutting the threaded bottle ring from the cylinder/tube. The threaded bottle ring is formed with an interior surface having a smooth cylindrical configuration positioned in facing contact upon the neck of the bottle. The threaded bottle ring is formed with an exterior surface having male threads. The male threads have crests of a first diameter. The threaded bottle ring has an annular upper edge and an annular lower edge.

The next step is providing a plurality of radial projections extending outwardly from the bottle, below and in contact with the lower edge of the threaded bottle ring, to abate downward movement of the threaded bottle ring.

The next step is sliding the threaded bottle ring onto the neck of the bottle.

The next step is forming a rolled collar in an annular cylindrical configuration extending outwardly from the bottle, above and in contact with the upper edge of the threaded bottle ring, to abate upward movement of the threaded bottle ring. The collar has a second diameter less than the first diameter.

The next step is coating the neck and the threaded bottle ring with a flavor guard polymer.

The next step is providing a beverage within the bottle.

The final step is removably positioning a crown cap on and in contact with the threaded bottle ring male threads of the threaded bottle ring and the collar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A one piece aluminum bottle comprising;

a closed bottom and an open mouth and a neck with a smooth frusta-conical exterior configuration, the bottle having a central axis with the neck at an angle from 0.5 to 2.5 degrees;

a threaded bottle ring, the threaded bottle ring formed with an interior surface having a smooth cylindrical configuration positioned in facing contact upon the neck of the bottle, the threaded bottle ring formed with an exterior surface having male threads, the male threads having crests of a first diameter, the threaded bottle ring having an annular upper edge and an annular lower edge, the treaded bottle ring being fabricated of aluminum;

a plurality of axial projections extending outwardly from the bottle, below and in contact with the lower edge of the threaded bottle ring, to abate downward movement of the threaded bottle ring;

a collar formed in an annular cylindrical configuration extending outwardly from the bottle, above and in contact with the upper edge of the threaded bottle ring, to abate upward movement of the threaded bottle ring, the collar having a second diameter less than the first diameter;

a crown cap removably positioned on and in contact with the threaded bottle ring male threads of the threaded bottle ring and the collar; and a beverage within the bottle adapted to be consumed following removal of the crown cap.

2. A method of fabricating a one piece aluminum bottle comprising:

providing an aluminum bottle having a closed bottom and an open mouth and a neck with a smooth frusto-conical exterior configuration;

creating a threaded bottle ring from a cylinder or tube of aluminum by forming male threads into the cylinder or tube then cutting the threaded bottle ring from the cylinder or tube, the threaded bottle ring formed with an interior surface having a smooth cylindrical configuration positioned in facing contact upon the neck of the bottle, the threaded bottle ring formed with an exterior surface having male threads, the male threads having crests of a first diameter, the threaded bottle ring having an annular upper edge and an annular lower edge, the treaded bottle ring being fabricated of aluminum;

providing a plurality of axial projections extending outwardly from the bottle, below and in contact with the lower edge of the threaded bottle ring, to abate downward movement of the threaded bottle ring;

sliding the threaded bottle ring onto the neck of the bottle; forming a rolled collar in an annular cylindrical configuration extending outwardly from the bottle, above and in contact with the upper edge of the threaded bottle ring, to abate upward movement of the threaded bottle ring, the collar having a second diameter less than the first diameter;

coating the threaded bottle ring with a flavor guard polymer;

providing a beverage within the bottle; and removably positioning a crown cap on and in contact with the threaded bottle ring male threads of the threaded bottle ring and the collar.

* * * * *